US006768798B1

(12) United States Patent
Dempsey

(10) Patent No.: US 6,768,798 B1
(45) Date of Patent: Jul. 27, 2004

(54) METHOD OF CUSTOMIZING HRTF TO IMPROVE THE AUDIO EXPERIENCE THROUGH A SERIES OF TEST SOUNDS

(75) Inventor: Morgan James Dempsey, Orlando, FL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 08/974,134

(22) Filed: Nov. 19, 1997

(51) Int. Cl.[7] ..... H04R 5/00; H04R 5/02

(52) U.S. Cl. ..... 381/17; 381/1; 381/309; 381/310

(58) Field of Search ..... 381/310, 309, 381/17, 1, 74, 26

(56) References Cited

U.S. PATENT DOCUMENTS 4,739,513 A * 4/1988 Kunugi et al. ..... 381/96
5,325,436 A * 6/1994 Soli et al. ..... 381/60
5,404,406 A * 4/1995 Fuchigami et al. ..... 381/17
5,438,623 A * 8/1995 Begault ..... 381/17
5,798,922 A * 8/1998 Wood et al. ..... 381/17
5,825,894 A * 10/1998 Shennib ..... 381/17
5,974,152 A * 10/1999 Fujinami ..... 381/1
6,067,361 A * 5/2000 Kohut et al. ..... 381/17
6,181,800 B1 * 1/2001 Lambrecht ..... 381/310

OTHER PUBLICATIONS

U.S. patent application Ser. No. 09/974,131, Dempsey, filed Nov. 19, 1997.

* cited by examiner

*Primary Examiner*—Minsun Oh Harvey
*Assistant Examiner*—Laura A. Grier
(74) *Attorney, Agent, or Firm*—Michael J. Ure

(57) ABSTRACT

A method of customizing the HRTF for each tested individual for providing all tested individuals an optimum audio experience by providing convincing and realistic three-dimensional sounds. Customization can be achieved by playing a series of sample sounds and having the tested individual locate where the sound is emanating from. In this way, the method can identify for each test subject which audible positional cues are most important, how frequency changes are interpreted as position, and what effects are most convincing and pleasurable. This information is used to effect the HRTF for each tested individual. The customized HRTF will then be applied to all three-dimensional sounds giving the listener an optimum audio experience.

1 Claim, 2 Drawing Sheets

METHOD OF CUSTOMIZING HRTF TO IMPROVE THE AUDIO EXPERIENCE THROUGH A SERIES OF TEST SOUNDS

RELATED APPLICATIONS

This application is related to the application entitled "METHOD FOR INTRODUCING HARMONICS INTO AN AUDIO STREAM FOR IMPROVING THREE DIMENSIONAL AUDIO POSITIONING" filed concurrently herewith, in the name of the same inventor, and assigned to the same assignee as this Application. The disclosure of the above referenced application is hereby incorporated by reference into this application.

BACKGROUND OF THE INVENTION

1. Field of the Invention

This invention relates generally to audio sounds and, more specifically, to a method for customizing the HRTF (Head Related Transfer Function) of individual listeners to provide more convincing and pleasurable three dimensional audio works.

2. Description of the Prior Art

Over the years, the audio industry has introduced new technologies that have steadily improved the realism of reproduced sounds. The 1940's monaural high fidelity technology led to the 1950's stereo. In the 1980's, digitally based stereo was introduced to improved the realism of reproduced sounds. Recently, spatial enhanced sound systems have come into existence. These systems give the listener a 180 degree, planner two dimensional presentation of sound. Listeners perceive a "widened" or "broadened" soundstage where sounds apparently are not limited to the space between the two speakers as in a conventional stereo system. Although offering more depth than conventional stereo systems, it falls short of providing full and realistic three-dimensional sounds.

Positional three-dimensional sound systems recreate all of the audio cues associated with a real world, and sometimes surrealworld, audio environment. The big difference between spatial enhanced and positional three-dimensional sound is that spatial sound uses two tracks and must evenly apply signal processing to all sounds on the track. Positional three-dimensional audio processes individual sounds according to Head Related Transfer Function (HRTF) techniques and then mixes the processed individual sounds back together before final amplification. This enables imbuing individual sounds with sufficient spatial cuing information to present an accurate, convincing rendering of an audio soundscape just as one would hear it in real life.

The problem with current positional three-dimensional sound systems is that it is not effective for all people. Each individual has a different HRTF based on the size and shape of their head and ears. An average HRTF will be convincing to most, but not all listeners. The further the individual's HRTF is from the average, the less convincing the experience. Even for those individuals where three-dimensional sound is effective, a majority of them will feel that the average function is realistic but not truly convincing because all of the audio cues do not correspond for them.

Therefore, a need existed to provide a method of improving three-dimensional sound for all listeners. The method must customize the three-dimensional sound for each listener in order to provide realistic and convincing three-dimensional sound for each listener. Customization can be achieved by playing a series of sample sounds and having each listener identify where the sound came from. The test will identify for each listener which audible positional cues are most important, how frequency changes are interpreted as position, and what effects are most convincing and pleasurable for each listener. The results can then be applied to all three-dimensional sounds providing all listeners an optimum audio experience.

SUMMARY OF THE INVENTION

In accordance with one embodiment of the present invention, it is an object of this invention to provide a method of improving three-dimensional sound for all listeners.

It is another object of the present invention to customize three-dimensional sounds for each listener in order to provide realistic and convincing three-dimensional sounds for each listener.

It is another object of the present invention to customize three-dimensional sounds by playing a series of sample sounds and having each listener identify where the sound came from in order to identify for each listener which audible positional cues are most important, how frequency changes are interpreted as position, and what effects are most convincing and pleasurable for each listener.

BRIEF DESCRIPTION OF THE PREFERRED EMBODIMENTS

In accordance with one embodiment of the present invention, a method of customizing an HRTF (Head Related Transfer Function) for an individual listener to provide the individual listener an optimum realistic audio experience. The method comprises the steps of: playing a series of positional test sounds for the individual listener; identifying positions of each of the series of positional test sounds by the individual listener; and modifying the HRTF to obtain the optimum realistic audio experience for the individual listener based on the individual listener identifying positions of each of the series of positional test sounds.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

What individuals interpret as simple sounds are actually made up of one or more frequencies. How the individual hears and interprets these frequencies determines where he/she thinks the sound came from. The human brain uses a plurality of different cues to discern where a particular sound is emanating from. The first cue the brain uses to locate sounds is the time difference between the sound reaching one ear and then the other ear. The ear that hears the sound first is closer to the source. The longer the delay to the more distant ear, the brain infers that the sound came from a greater angle from the more distant ear to the sound source. Using triangulation, the brain discerns where the sound came from horizontally. Unfortunately, this method has a few limitations. If only interaural time differences are used, the brain is unable to distinguish whether the sound is above or below the horizontal plane of the ears. Second, the brain is unable to distinguish between front and back. The time delay for 60 degrees to the right front is the same as the delay for 60 degrees to the right ear. Third, only sounds at certain frequencies can be used for calculating time differences.

To distinguish time delays between the ears, the brain must be able to discern a clear and identifiable difference between the sound as it reaches the two ears. Human heads are about seven inches wide at the ears. Sound travels in air at about 1088 feet per second. Humans can hear sounds between 20 and 20,000 Hz with the wavelength been directly related to the frequency according to the equation:

$$\text{Frequency}=1088/\text{Wavelength} \quad (1)$$

Figure 2:
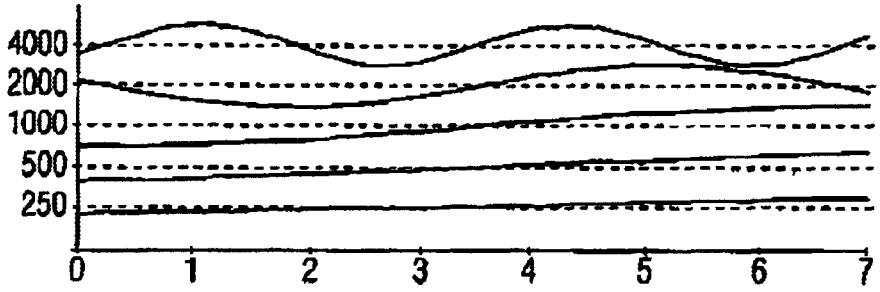
FIG. 2 shows the signal differences for different frequencies between two ears.

FIG. 2 shows the maximum signal difference for different frequencies between two ears approximately seven inches apart. At very low frequencies (i.e., under 250 Hz) the difference between the signal at the two ears is minimal. Therefore, the brain cannot effectively identify time differences. At frequencies above 2000 Hz, the wavelengths are shorter than seven inches. Thus, the brain cannot tell that one ear is a cycle or more behind the other and cannot correctly calculate the time difference. This means that the brain can only calculate time delays for audio frequencies between 250–1500 Hz.

A second cue used for determining horizontal direction is sound intensity. Noises come from the right sound loudest to the right ear. The left ear perceives a lower intensity sound because the head creates an audio shadow. As with time difference calculations, sound frequency affects right/left intensity perceptions. The average seven inch wide head can only shadow frequencies higher than 4000 Hz.

Figure 3:
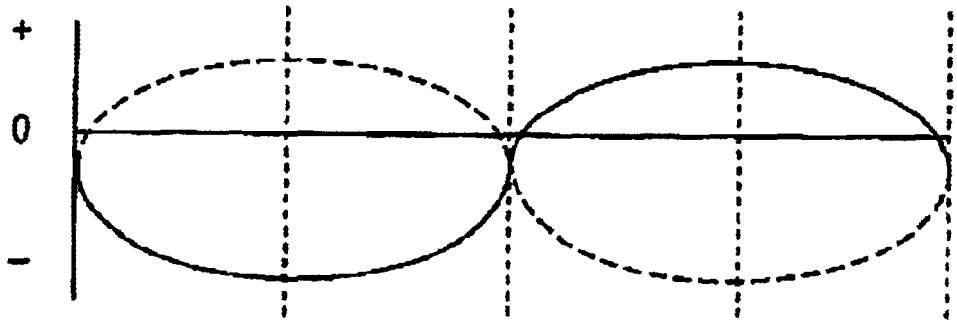
FIG. 3 shows the effect of the audio shadow created by a head.

FIG. 3 shows the head shadow effect. Remember, the brain registers the difference between the two ears. The actual shape of the curves change with frequency. Just as with time difference calculations, intensity difference calculations cannot account for vertical positioning (i.e., elevation) or front-to-back positions.

Two frequency bands have been neglected up to this point: the sub 250 Hz band, and the 1500 to 4000 Hz band. As can be seen from FIG. 1, the human brain has no ability to identify the position of a sound in these ranges. If a sound is made up of a pure sine wave in the 3000 Hz range, humans would not be able to locate the source. This is why in a crowded room when a pager goes off (i.e., the pager making a sound having a pure tone having a frequency which the human brain has no ability to identify the position of the sound), no one can determine who's pager went off, so everyone checks. Fortunately, most sounds are not pure tones.

Humans perceive sounds from behind as being muffled. The shape of the human head and the slightly forward facing ears work as audio frequency filters. Frequencies between 250 and 500 Hz and above 4000 Hz are relatively less intense when the source is behind the individual. Frequencies between 800 and 1800 Hz are less intense when the source is in front. Most sounds, including high intensity ones, are made up of many different frequencies. If an individual perceives that higher frequencies, those between 800 to 18,000 Hz, are louder than lower ones (those in the 250 to 500 Hz range), then the person assumes that the sound source was in front. If the lower frequency components seem louder, the person assumes that the sound source was from behind.

A person's memory of common sounds also assists the brain in frequency evaluations. Unconsciously, individuals learn the frequency content of common sounds. When an individual hears a sound, he/she will compare it to the frequency spectrum in his/her memory. The spectrum rules concerning front or back location of the source completes the calculations. Sometimes, the front to back location is still unclear. Without thinking, people turn their heads to align one ear towards the sound source so that the sound intensity is highest in one ear.

Identifying the location of a sound source on a horizontal plane is relatively easy for two ears, but locating a sound in the vertical direction is much harder and inherently less accurate. As before, frequency is the key. However, a sound's interaction with the ear's pinna (i.e., the folds in the outer part of the ear) provide clues to the location of sounds.

Figure 4:
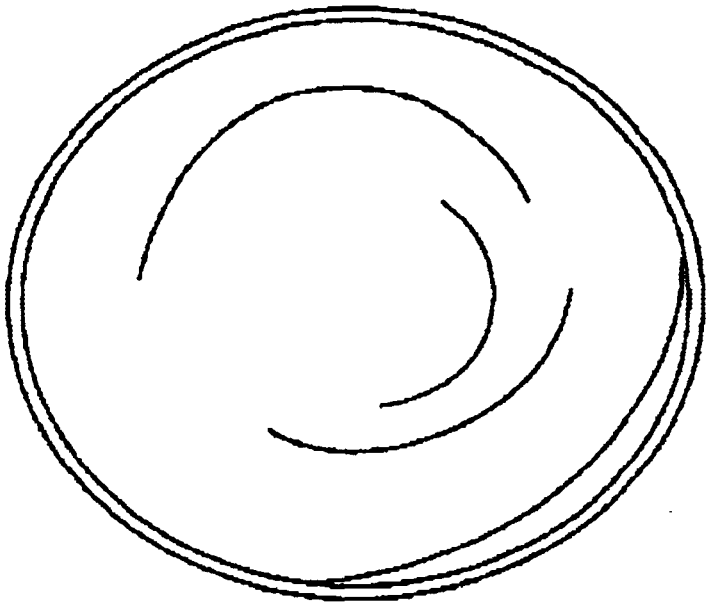
FIG. 4 shows the non-uniform sound interaction with the pinna of the ears.

As can be seen in FIG. 4, the pinna creates different ripples depending on the direction where the sound came from. Each fold in the pinna creates a unique reflection. The reflections depend on the angle at which the sound hits the ear and the frequency of the sounds heard. A cross section of any radius gives a unique ripple pattern that identifies not only up or down, but also supports the interpretation of front and back.

The wavelength and magnitude of the ripples create a complex frequency filter. The brain uses the high frequency spectrum to locate the vertical sound source. For any given angle of elevation, some frequencies will be enhanced, while others will be greatly reduced. The brain correlates the frequency response it hears with a particular angle, and the vertical direction is identified.

Unfortunately, there are some limitations to our ability to determine elevation in sound sources. The pinna is only effective with frequencies above 4000 Hz. If a sound is made up entirely of frequencies below 4000 Hz, the pinna effect will be negligible and the person will not be able to identify the vertical direction of the source.

Sound sources that are near by seem to be louder than those that are farther away. This feature of sound is called rolloff. Objects in the path of the sound wave may act as filters to attenuate higher frequency components. Listening to someone across a lake, a person can hear them clearly as if they were near by. This is due to the fact that the lake is smooth. The lake is a perfect reflector with nothing to interfere with the sound waves. Given the same distance in a dense forest, one would not be able to hear as clearly. The trees would interfere with the sound waves. The trees would absorb and redirect the sound waves, making identification of the sounds virtually impossible.

A radio in an open field sounds flat and mute when compared to the same radio playing in an enclosed room. Sounds reflected by the floors and walls in the enclosed room help counter rolloff and add depth to the sounds. The brain does not confuse reflection variations (ripples, time delays, and echoes) because the time differences are significant. Ripples are on the order of less than 0.1 ms. Time delays are less than 0.7 ms. Echoes result from reflections from objects or walls. Echoes are only noticeable if the delay is greater than 35 ms. Echoes with delay times of less than 35 ms are filtered out and ignored by the brain. However, sub 35 ms echoes create the reverb content, or richness individuals perceive in sounds subject to reflection.

Motion also plays a role is sound determination. Everyone has noticed that an approaching ambulance siren sounds increasingly high pitched until it reaches the listener. The ambulance siren sounds progressively lower pitched as it recedes. This is called the Doppler effect. This effect would be the same if the ambulance remained stationary and the listener moved passed the ambulance at road speed. The faster the relative speed, the greater the frequency shift. The frequency shift occurs because as the sound approaches objects, the leading sound wave is compressed into shorter wavelengths while the trailing waves, if any, are "stretched" into longer waves. Shorter waves are higher in frequency. So as a sound source approaches, all the sounds have a higher frequency. The trailing waves of sound sources that are moving away would be lower in frequency.

Sounds emanating from point sources expand outward to form directional sound cones. Consider a man with a megaphone. When the megaphone is pointed more or less at a listener (i.e., the inner cone), the volume remains constant. As the megaphone swings away from the observer (i.e., the outer cone), the volume drops rapidly. Then there comes a point where the megaphone turns outside the cone and the volume remains virtually constant and low.

A listener right and left ears may be located in different cones generated by a single sound. Consider a person whispering in your ear. One ear is the inner cone while the other ear is both in the inner and outer cone. Consider the same person whispering a few feet away. One ear is the inner cone while the other ear is in the outer cone. While this defeats some of the positional identification, it is an integral part of a person's perception of the audile world.

The Head Related Transfer Function (HRTF) is a mathematical model that describes how the brain and ear work together to perceive sounds in positional three-dimensional space. HRTF makes the difference between our experience and that of recording. HRTF is a function that identifies sound intensities as a function of direction. All of the frequency related concepts discussed above are based on this function.

Each person learns the response of their own HRTF from infancy. HRTF is greatly effected by the size and shape of the listeners head and ears. Since all people are slightly different, every individual has a unique HRTF. Three-dimensional audio works because most people's HRTF are similar enough to be convincing to a majority of people. However, many people are not convinced by standard three-dimensional audio sounds. Furthermore, even for those individuals where three-dimensional audio sounds are effective, a majority of them will feel that the average function is realistic but not truly convincing.

The more cues an individual listener is exposed to, the better the individual's brain is able to identify and distinguish where the particular sound is coming from. Customizing the HRTF for each listener to positional cues which are the most convincing to the listener will improve the audio experience and will provide realistic three-dimensional audio works for each individual listener.

Customization may be achieved by playing a set of sample sounds for each listener. The sounds must be essentially positioned. The listener must identify where each sound is emanating from or that the sound is not convincing (i.e., he/she doesn't know where the sound is emanating from). In this way, the test may identify for each test subject, which audible positional cues are most important, how frequency changes are interpreted as position, and what effects are most convincing or pleasurable.

The sample sounds may be a fixed set of sample sounds, or may be a modified set of sample sounds based on prior results of a particular listener. However, when testing, it is important to use a wide spectrum of sample sounds (i.e., sounds containing both low and high frequencies such as white noise have a hugh spectrum of sounds). This will enable the listener's brain to line up a plurality of cues in order to best determine where the sound is emanating from. If none of the cues or only a few cues line up, a listener's brain may not be able to fully identify where the sound is located.

Figure 1:
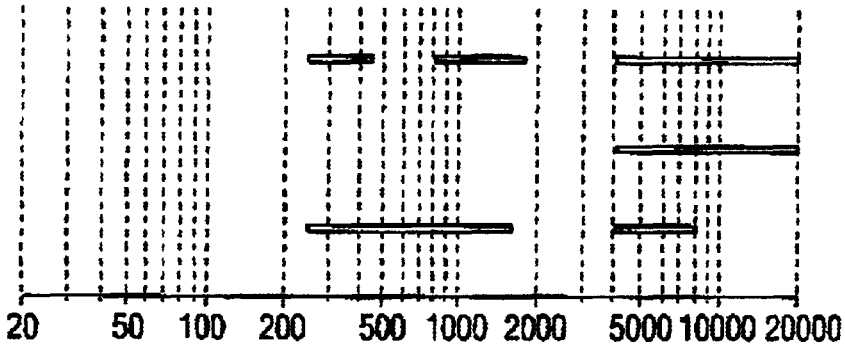
FIG. 1 shows the positional cues as a function of frequency.

The sample sounds may be broken up into a plurality of different frequency ranges. As seen in FIG. 1, certain frequency ranges are related to different positional cues. A plurality of sound samples may be played in each frequency range to determine which frequencies are best suited as positional cues for each listener. By altering the frequency of the sample sounds, one may be able to determine how frequency changes are interpreted as position by the listener's responses.

When playing the series of test sounds, the listener must identify where he/she thought the sound was emanating from. Based on the listener's response, the HRTF of the individual listener may be customized to matched up to what the individual thought he/she was hearing. For example, when playing each sample test sound, the listener will identify each sound as emanating from the front, behind, above, below, right, left, a combination thereof, or undistinguishable. The tester will then be able to identify that certain frequency responses for each listener corresponds to sounds that emanating from a particular location. The frequency response of each listener can then be modified to those frequencies which the individual listener is best able to identify as the location of the sound source. This information is used to effect the HRTF for each tested individual. The customized HRTF will then be applied to all three-dimensional sounds giving the listener an optimum audio experience.

While the invention has been particularly shown and described with reference to preferred embodiments thereof, it will be understood by those skilled in the art that the foregoing and other changes in form, and details may be made therein without departing from the spirit and scope of the invention.

What is claimed is:

1. A method for determining a head related transfer function (HRTF) for an individual listener, comprising:

playing a series of wide-spectrum sample sounds each including high and low audio frequencies from a plurality of virtual three-dimensional positions surrounding an individual human listener, such that said high and low audio frequencies includes sounds in the ranges of 250–450 Hz, 800–1800 Hz, and 4000–20,000 Hz for a set of front/back tests, said high and low audio frequencies include sounds in the range of 4000–20,000 Hz for a set of up/down tests, and said high and low audio frequencies includes sounds in the ranges of 250–1800 Hz and 4000–20,000 Hz for a set of right/left tests;

identifying a plurality of apparent three-dimensional positions such sample sounds appear to be coming-from by said individual human listener as front, behind, above, below, right, left, a combination, or undistinguishable;

determining an HRTF for said individual human listener by comparing differences in respective ones of said virtual three-dimensional positions and said apparent three-dimensional positions; and correcting thereafter at least one audio performance for said individual human listener with said HRTF to create a convincing three-dimensional sound effect.

* * * * *